US006206112B1

(12) United States Patent
Dickinson, III et al.

(10) Patent No.: US 6,206,112 B1
(45) Date of Patent: Mar. 27, 2001

(54) MULTIPLE LATERAL HYDRAULIC DRILLING APPARATUS AND METHOD

(75) Inventors: Ben Wade Oakes Dickinson, III, San Francisco; Robert Wayne Dickinson, San Rafael; Robert Nordlund, San Pablo, all of CA (US)

(73) Assignee: Petrolphysics Partners LP, San Francisco, CA (US)

( * ) Notice: Subject to any disclaimer, the term of this patent is extended or adjusted under 35 U.S.C. 154(b) by 0 days.

(21) Appl. No.: 09/603,611

(22) Filed: Jun. 26, 2000

Related U.S. Application Data

(62) Division of application No. 09/080,139, filed on May 15, 1998.

(51) Int. Cl.[7] ..... E21B 7/18
(52) U.S. Cl. ..... 175/67; 175/175; 175/100
(58) Field of Search ..... 175/67, 61, 81, 175/393, 418, 100, 107

(56) References Cited

U.S. PATENT DOCUMENTS

| | | | | |
|---|---|---|---|---|
| 4,527,639 | | 7/1985 | Dickinson et al. . | |
| 4,763,734 | | 8/1988 | Dickinson et al. . | |
| 4,790,394 | | 12/1988 | Dickinson et al. . | |
| 4,856,600 | | 8/1989 | Baker et al. . | |
| 5,199,512 | * | 4/1993 | Curlett | 175/67 |
| 5,373,906 | * | 12/1994 | Braddick | 175/67 |
| 5,597,046 | * | 1/1997 | Fisk | 175/67 |

* cited by examiner

*Primary Examiner*—Frank Tsay
(74) *Attorney, Agent, or Firm*—Flehr Hohbach Test Albritton & Herbert LLP

(57) ABSTRACT

Hydraulic drilling apparatus and method in which a hole is formed with a series of drill heads and strings of successively smaller diameter. After each section of the hole is formed, the drill head is withdrawn back through the string, leaving the string in place in the hole to serve as a casing for the well. The next smaller size drill head and string are then introduced through the strings which have already been placed, and the process is repeated until the hole has reached the desired length. The course of the hole can be changed, e.g. from vertical to horizontal, without interruption of the drilling process by selective application of the drilling fluid to the nozzles in the drill head to steer the advancing string. Multiple laterals are formed by introducing a module having a plurality of extensible drilling tubes with drill heads at the distal ends thereof into the string and applying the pressurized drilling fluid to the module to advance the tubes from the string. The direction of the holes formed with the tubes is controlled by inclining the drill heads at oblique angles relative to the axes of the tubes. Once the laterals have been drilled, the module is withdrawn from the string, and the drilling tubes can either be withdrawn with the module or they can be cut off and left in the well. In one disclosed embodiment, the drill heads which form the laterals have a generally hemispherical nose with a plurality of vortex generators or nozzles distributed thereover. In another, the drill heads have a hemispherical button projecting from a forwardly facing planar surface, with forwardly directed nozzle openings toward the front of the button and laterally directed nozzle openings in the base of the button near the planar surface.

7 Claims, 6 Drawing Sheets

MULTIPLE LATERAL HYDRAULIC DRILLING APPARATUS AND METHOD

This is a division of Ser. No. 09/080,139, filed May 15, 1998.

This invention pertains generally to the drilling of boreholes in the earth and, more particularly, to apparatus and a method of drilling by the use of hydraulic jets.

For many years, oil and gas wells have been drilled by a rotary bit mounted on a tubular drill string which extends down the borehole from the surface of the earth. The drill string is rotated at the surface, and the rotary motion is transmitted by the string to the bit at the bottom of the hole. A liquid commonly known as drilling mud is introduced through the drill string to carry cuttings produced by the bit to the surface through the annular space between the drill string and the wall of the borehole. This method of drilling has certain limitations and disadvantages. The string must be relatively heavy in order to transmit torque to the bit at the bottom of the hole. In hard rock, the drilling rate is slow, and the bit tends to wear rapidly. When the bit must be replaced or changed, the entire string must be pulled out of the hole and broken down into tubing joints as it is removed. It is necessary to use heavy, powerful machinery to handle the relatively heavy drill string. It is also necessary to install a casing in the well as it is drilled. The string is relatively inflexible and difficult to negotiate around bends, and frictional contact between the string and the well casing or bore can produce wear as well as interfering with the rotation of the drill bit. Powerful equipment is also required in order to inject the drilling mud with sufficient pressure to remove cuttings from the bottom of the well.

More recently, wells and other boreholes have been drilled with high velocity streams or jets of fluid directed against the material to be cut. Examples of this technique are found in U.S. Pat. Nos. 4,431,069, 4,497,381, 4,501,337 and 4,527,639. In U.S. Pat. Nos. 4,431,069 and 4,501,337, the cutting jets are discharged from the distal end of a hollow pipe positioned within an eversible tube having a rollover area which is driven forward by pressurized fluid. U.S. Pat. Nos. 4,497,381 and 4,527,639 disclose hydraulic jet drill heads attached to drilling tubes which are driven forward by hydraulic pressure, with means for bending the tube to change the direction of drilling, e.g. from horizontal to vertical.

U.S. Pat. Nos. 4,787,465, 4,790,394 and 4,852,668 disclose hydraulic drilling apparatus in which pressurized drilling fluid is discharged through a nozzle as a high velocity cutting jet in the form of a thin conical shell. The direction of the borehole is controlled by controlling the discharge of the drilling fluid, either in side jets directed radially from the distal end portion of the drill string which carries the drill head or in a plurality of forwardly facing cutting jets aimed ahead of the drill string so as to modify the geometry of the hole being cut. Other drill heads in which steering is effected by controlled discharge of the drilling fluid through jets of different orientations are disclosed in U.S. Pat. Nos. 4,930,586 and 4,991,667.

U.S. Pat. Nos. 4,787,465, 4,790,394 and 4,852,668 also disclose a seal arrangement which permits a hydraulic drill head to be removed or withdrawn from a drill string without removing the string from the borehole, and U.S. Pat. No. 5,255,750 discloses a system and method for controlling the rate of advancement or penetration of a hydraulic drill head.

Recent expansion of offshore drilling has created a shortage of offshore drilling rigs, with increasing costs and delays in the drilling of such wells. In the past two years, for example, the daily rate charges for offshore drilling ships have doubled or tripled, and the only way to reduce drilling costs significantly is to decrease the time required to drill the wells.

It is in general an object of the invention to provide a new and improved hydraulic drilling apparatus and method.

Another object of the invention is to provide a drilling apparatus and method of the above character which are particularly suitable for use in the drilling of offshore wells and other wells.

Another object of the invention is to provide a drilling apparatus and method of the above character which reduce the time and cost of drilling offshore wells.

These and other objects are achieved in accordance with the invention by providing a hydraulic drilling apparatus and method in which a hole is formed with a series of drill heads and strings of successively smaller diameter. After each section of the hole is formed, the drill head is withdrawn back through the string, leaving the string in place in the hole to serve as a casing for the well. The next smaller size drill head and string are then introduced through the strings which have already been placed, and the process is repeated until the hole has reached the desired length. The course of the hole can be changed, e.g. from vertical to horizontal, without interruption of the drilling process by selective application of the drilling fluid to the nozzles in the drill head to steer the advancing string.

Multiple laterals are formed by introducing a module having a plurality of extensible drilling tubes with drill heads at the distal ends thereof into the string and applying the pressurized drilling fluid to the module to advance the tubes from the string. The direction of the holes formed with the tubes is controlled by inclining the drill heads at oblique angles relative to the axes of the tubes. Once the laterals have been drilled, the module is withdrawn from the string, and the drilling tubes can either be withdrawn with the module or they can be cut off and left in the well.

In one disclosed embodiment, the drill heads which form the laterals have a generally hemispherical nose with a plurality of vortex generators or nozzles distributed thereover. In another, the drill heads have a hemispherical button projecting from a forwardly facing planar surface, with forwardly directed nozzle openings toward the front of the button and laterally directed nozzle openings in the base of the button near the planar surface.

Figure 1:
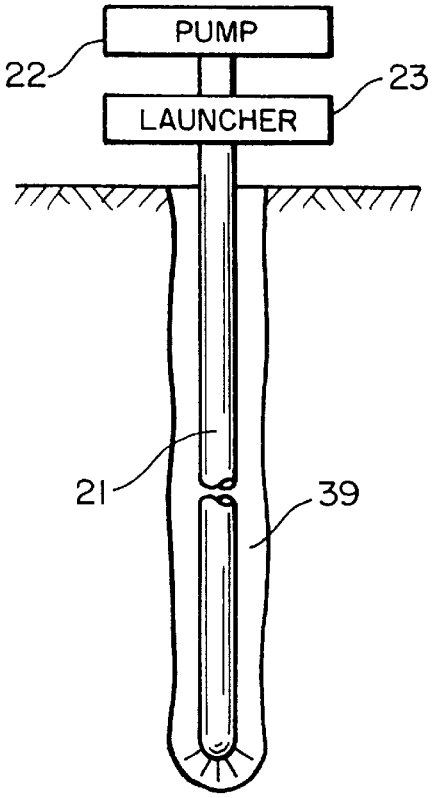
FIG. 1 is an elevational view of one embodiment of hydraulic drilling apparatus incorporating the invention.
Figure 2:
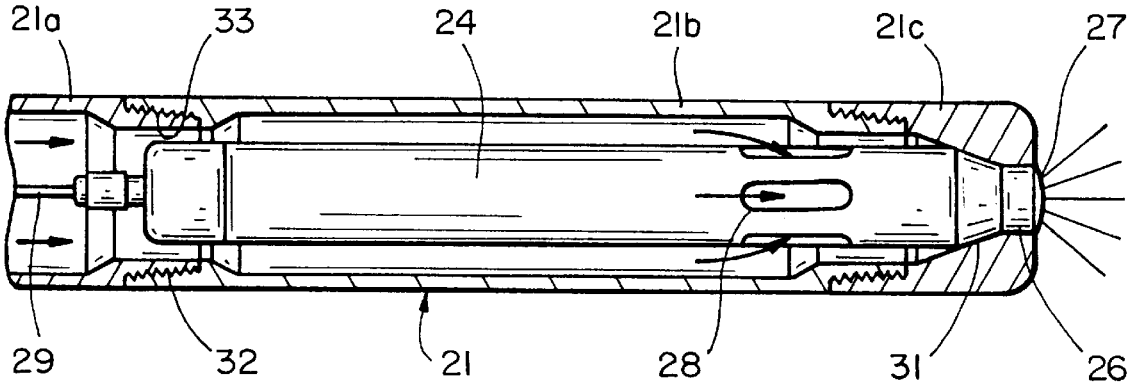
FIG. 2 is an enlarged sectional view of the distal end portion of the drill string in the embodiment of FIG. 1.

As illustrated in FIGS. 1 and 2, the drilling apparatus includes an elongated tubular drill string 21 which is connected to a source of pressurized drilling fluid 22 and a launcher 23 which can be carried by a drilling ship (not shown) or otherwise located at the surface of the earth. A drilling and control module 24 having a drill head 26 at the distal end thereof is positioned within the distal end portion of the string. The drill head has a plurality of nozzles 27 through which the pressurized drilling fluid is discharged in the form of high velocity cutting jets, and ports 28 in the wall of module permit the fluid to pass from the string to the drill head. The module contains instrumentation for sensing the orientation and position of the drill head, and valves for controlling the delivery of pressurized fluid to the nozzles to control the direction in which the hole is bored. Systems in which a drill string is steered in this manner are disclosed in greater detail in U.S. Pat. Nos. 4,787,465, 4,930,586 and 4,991,667. A wire line 29 extends from the rear of the module for carrying electrical signals and/or power between the surface of the earth and the module.

The drilling and control module abuts against a lip seal 31 at the distal end of the drill string and is urged into engagement with the seal by the pressurized drilling fluid. The module is of lesser diameter than the string, and can be withdrawn or retrieved through the string without removing the string from the well. This enables the string to be used as a casing for the well in addition to serving as a conduit for the pressurized fluid during the drilling process.

The string consists of a plurality of sections 21*a*, 21*b* which are threaded together, with a nose section 21*c* at the distal end of the string. The joints between the sections are flush joints in which male threads 32 at one end of each section are offset inwardly from the side wall of the section and received in female threads 33 in the opposite end of the next section, with no external protrusion at the joints to impede the passage of the string into the hole.

Figure 3:
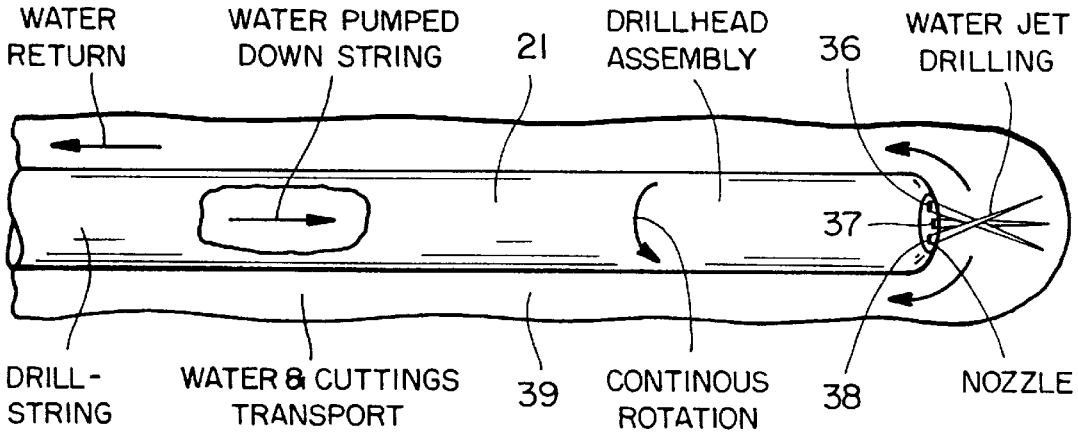
FIG. 3 is an elevational view, partly broken away, of another embodiment of apparatus incorporating the invention.

If desired, the string can be rotated slowly (e.g., 5–10 RPM) during the drilling process to reduce friction as the string advances through the earth. In the embodiment illustrated in FIG. 3, the drill head has three forwardly directed nozzles 36–38, each of which is inclined at a different angle relative to the axis of the string, with a separate control valve (not shown) for each nozzle. As the string rotates, the valves are actuated to turn the jets on and off to steer the drill head in the desired direction. For example, the most obliquely inclined of the jets can be turned on only during a portion of each revolution to deflect the string in a direction opposite to the direction of the jet.

The hole which is bored is of greater diameter than the drill string, and spent fluid and cuttings flow to the surface through an annular region 39 between the outer wall of the string and the wall of the borehole. If desired, the apparatus can be operated as a closed loop, or sealed, system in which the cuttings are separated from the fluid at the surface for disposal and the fluid is recirculated.

Once the hole has been drilled to the desired depth and the drilling and control module has been withdrawn, the well can be sealed by pumping cement 41 down through the string to fill the annular region between the string and the earth.

Figure 4:
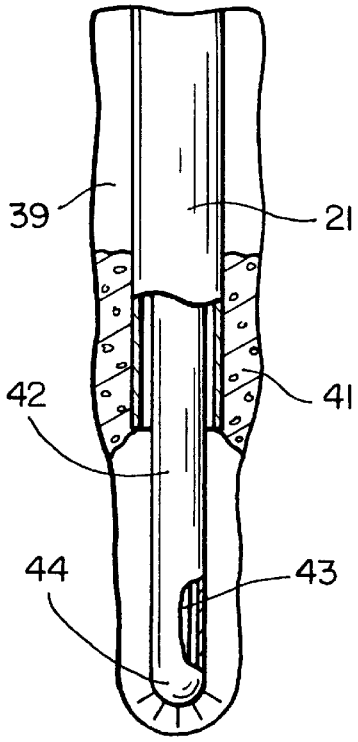
FIG. 4 is a fragmentary elevational view, partly broken away, of another embodiment of apparatus incorporating the invention.

After drilling as far as possible with one size drill head, the hole can be extended by withdrawing that drill head and continuing on with a smaller one. Referring now to FIG. 4, after the first drill head is removed, cement is pumped down through the string to seal that string in place, then a smaller drill string 42 with a drilling and control module 43 at the distal end thereof is pumped down through the first string. Module 43 is similar to module 24 except it is smaller in diameter, and has a smaller drill head 44 at its distal end. As drill string 42 advances, spent drilling fluid and cuttings flow up through the annular region 39 outside it until they reach string 21, then pass flow up through that string to the surface. When string 42 reaches the desired depth, module 43 is withdrawn, and cement is pumped down through string 42 to fill the region around it and seal it to the earth.

If further extension of the hole is desired, a smaller drill string can be pumped down through drill string 42, and the process can be repeated with successively smaller strings until the desired depth is reached.

Figure 5:
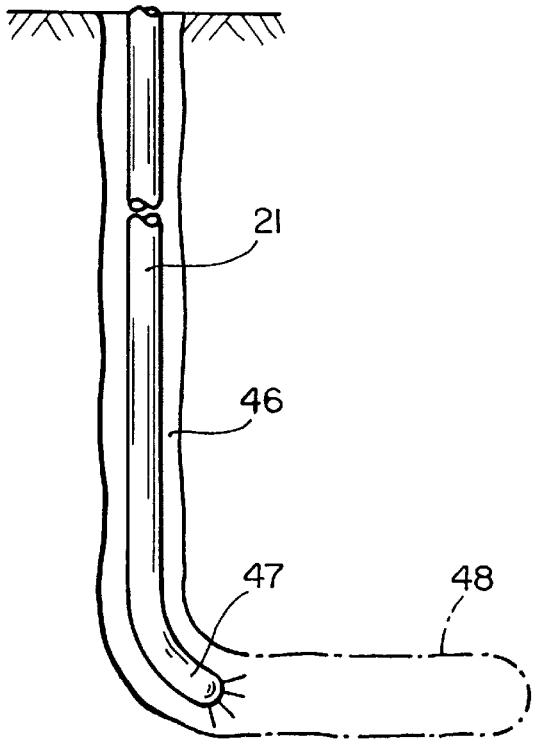
FIG. 5 is an elevational view of another embodiment of hydraulic drilling apparatus incorporating the invention.

As illustrated in FIG. 5, utilizing the invention it is possible to drill a vertical hole 46 to a desired depth, then steer the drill head around a 90° bend 47 and continue drilling in a horizontal direction 48 without interruption of the drilling process. A rotating 4½ inch diameter string, for example, will make a medium radius turn of about 400 feet in going from the vertical direction to horizontal. The well can then extend in the horizontal direction for an extended distance, e.g. up to about 25,000 feet.

Figure 6:
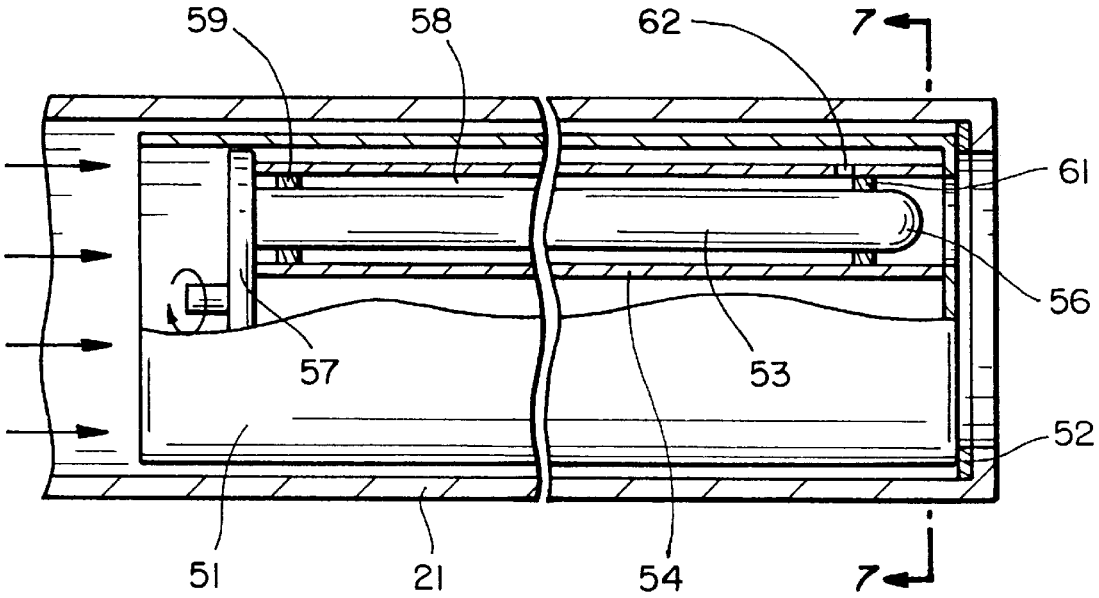
FIG. 6 is a side elevational view, partly broken away of one embodiment of a module for drilling multiple lateral bores in accordance with the invention.
Figure 7:
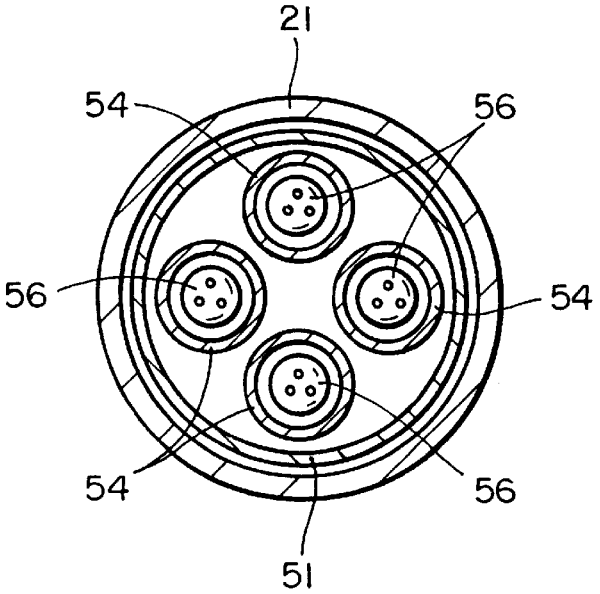
FIG. 7 is a cross sectional view taken along line 7—7 in FIG. 6.

FIG. 6 illustrates a module for drilling a plurality of laterals from the distal end of a borehole such as the horizontal extension in the embodiment of FIG. 5. This module includes a flexible cylindrical housing or canister 51 of slightly smaller diameter than the string through which it is introduced. It is propelled through the string by the pressurized drilling fluid and abuts against a lip seal 52 at the distal end of the string.

A plurality of lateral drilling tubes 53 are mounted in longitudinally extending guide tubes 54 for extension beyond the distal end of the housing. The tubes are fabricated of a seamless, coiled tubing and have a length on the order of 30 to 100 feet, with drill heads 56 at the distal ends thereof. In the embodiment illustrated, four tubes are disposed in quadrature within the housing, but any suitable number of tubes can be used. With a housing sized for use in a string having a diameter of 4½ inches, the drilling tubes can a diameter on the order of 1½ inches. With ⅝ inch drilling tubes, a housing of that size will accommodate up to eight tubes. In most common oil field formations, the 1½ inch tubes will drill boreholes having a diameter on the order of 2–4 inches, and ⅝ inch tubes will produce boreholes with a diameter on the order of one inch.

The drilling tubes are extended from the housing by hydraulic pressure in much the same manner that the drill string is advanced through the formation. The pressurized drilling fluid is applied to the proximal ends of the tubes, one at a time, by a rotary valve 57 and is discharged through the drill heads 56 at the distal ends of the tubes. That valve can, for example, be of the type disclosed in U.S. Pat. No. 4,790,394 for controlling the delivery of fluid to a plurality of nozzles. Extending only one of the drilling tubes at a time requires substantially less pressurized fluid and pump capacity than would be required to extend all four of the tubes at once. However, if sufficient pumping capacity is provided, all of the laterals can be drilled at the same time.

The rate at which each of the drilling tubes is extended is controlled by releasing a limited amount of pressurized fluid from a chamber 58 which decreases in volume as the tube advances. This chamber is formed between annular seals 59, 61 which are affixed to the proximal ends of the drilling tubes and the distal ends of the guide tubes, with orifices 62 in the guide tubes through which a controlled amount of fluid entrapped in the chambers can escape.

Figure 8:
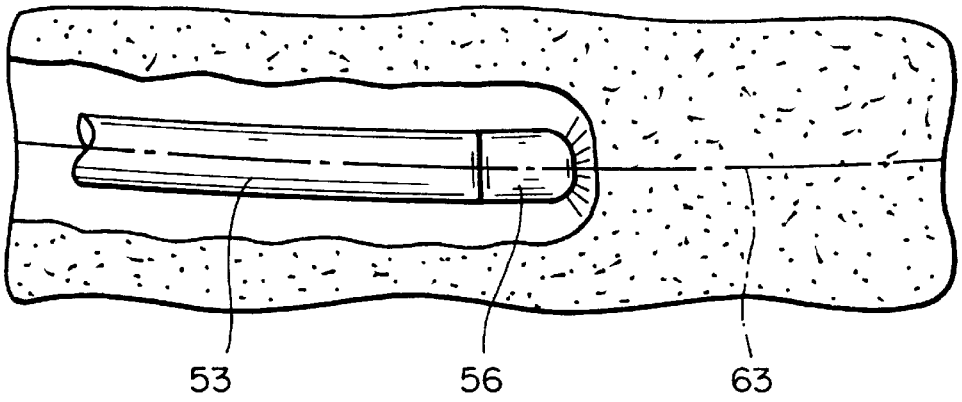
FIG. 8 is a top plan view of one of the drill heads and the distal end portion of the associated drilling tube in the embodiment of FIG. 6.

As illustrated in FIG. 8, drill heads 56 are inclined at oblique angles relative to the axes of the drilling tubes to control the direction in which the laterals are drilled. With the heads inclined in this manner, each of the tubes will tend to travel in a curved trajectory 63 in the plane of the angle with a radius of curvature and sense (clockwise or counter-clockwise) determined by the angle of the head. Angles on the order of 1° to 3° have been found to give radii of curvature on the order of 100 to 200 feet.

Figure 9:
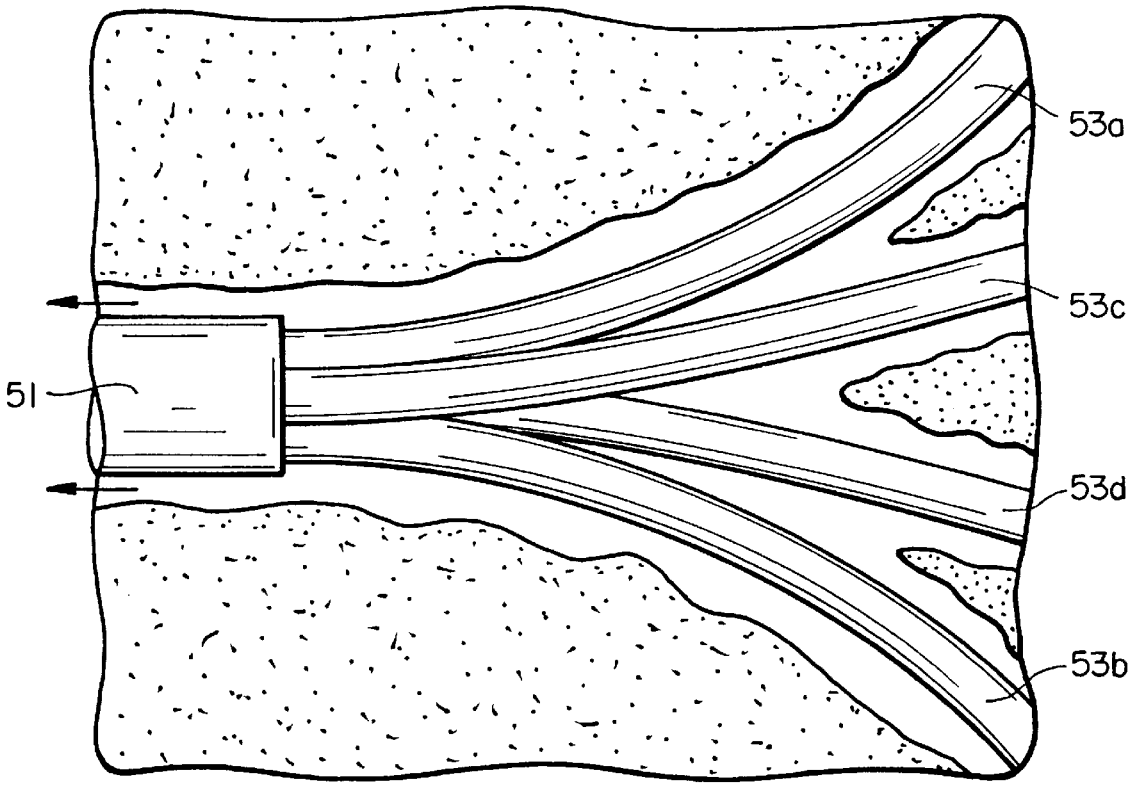
FIG. 9 is a fragmentary plan view of the embodiment of FIG. 6 with the drilling tubes extended.

In one presently preferred embodiment which is illustrated in FIG. 9, the heads on the four drilling tubes are arranged to provide an outwardly diverging pattern of laterals in a horizontal plane. For this purpose, the heads on two of the tubes 53*a*, 53*b* are inclined in opposite directions to provide radii of curvature of approximately 100 feet, and the heads on the other two tubes 53*c*, 53*d* are inclined in the opposite directions to provide radii curvature of approximately 200 feet. With these angles, the four laterals are formed generally in a horizontal plane, with the two innermost laterals curing away from each other with 200 foot radii of curvature and the two outermost laterals curving away from each other with 100 foot radii of curvature.

If desired, the heads can be oriented to provide other directions of curvature such as a combination of horizontal and vertical like the legs of a stool.

Once the laterals have been drilled, the module can be withdrawn from the drill string using a wire line, a sucker rod or other suitable means. The drilling tubes can either be withdrawn with the module, or they can be cut off by suitable means such as electrochemical cutting and left in the formation.

Further extension into the formation can be made by introducing another string of smaller diameter into the well and extending it out though the end of the horizontal section. Another set of multiple laterals can then be drilled through that string. Thus, as each local reservoir zone in a formation is depleted, that zone can be isolated and cased off, and another set of laterals can be extended.

Drill heads 56 can be of any suitable design such as the conical jet drill head disclosed in U.S. Pat. No. 4,790,394. Such drill heads have an internal chamber in which the pressurized drilling fluid is turned into a whirling mass and a nozzle through which the whirling fluid is discharged as a high velocity cutting jet in the form of a thin conical shell.

Figure 10:
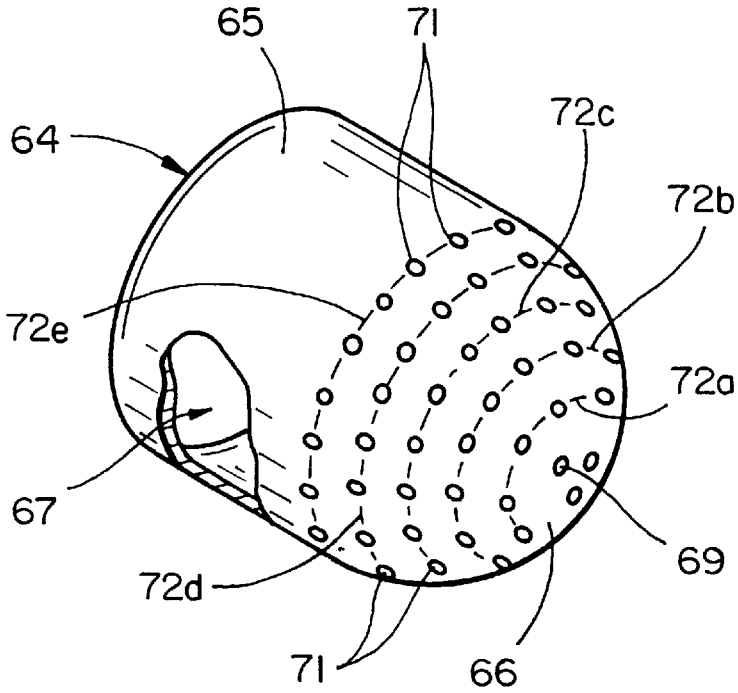
FIG. 10 is an isometric view, partly broken away, of one embodiment of a drill head for use in the embodiment of FIG. 6.

Another suitable drill head for use in drilling the laterals is illustrated in FIG. 10. This head has a rigid body 64 with a cylindrical side wall 65, a hemispherically curved end wall or nose 66, and an internal chamber 67 which communicates directly with the interior of the drilling tube on which the head is mounted. A plurality of vortex generators are distributed over the nose in the form of nozzles which communicate with the chamber and discharge the pressurized fluid in the form of high velocity vortical cutting jets. The embodiment illustrated has three forwardly facing nozzles 69 which are inclined obliquely to the axis of the drill head, and a plurality of nozzles 71 which are inclined in a manner which produces the vortex action.

In that regard, nozzles 71 are arranged in rings 72*a*–72*e* which are disposed concentrically about the axis of the drill head. The nozzles in each of the rings are directed along a conical surface, with the vertices of all of the cones being at the center of the hemisphere. Rather than extending perpendicular to the surface of the nose however, the nozzles are inclined at an angle on the order of 5° to the perpendicular direction, with the nozzles in alternate rings being inclined in opposite directions. Thus, for example, in one embodiment, the nozzles in rings 72*a*, 72*c* and 72*e* are inclined in a clockwise direction as viewed from the front of the drill head, and the nozzles in rings 72*b* and 72*d* are inclined in a counter-clockwise direction. Thus, alternate rings of nozzles produce conical masses of drilling fluid which whirl in opposite directions, producing a vortex action where they impact upon the formation.

This drill head is particularly effective in cutting carbonates and non-crystalline, homogeneous, non-fractional rocks. It is also useful for cutting sandstone and granite formations.

Figure 11:
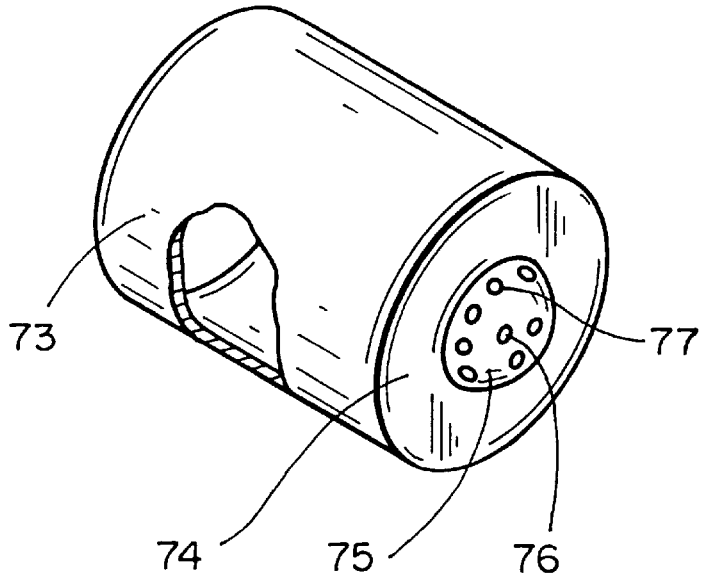
FIG. 11 is an isometric view, partly broken away, of another embodiment of a drill head for use in the embodiment of FIG. 6.

FIG. 11 illustrates another drill head which will cut the same formations as the embodiment of FIG. 10, but with a substantially lesser number of jets. This head has a cylindrical body 73 with a forwardly facing annular planar wall 74 and a hemispherical button 75 which protects in a forward direction from the planar wall. It has three forwardly facing nozzles 76 toward the tip of the button inclined obliquely to the axis of the nozzle and 10 laterally extending nozzles 77 in the base portion of the button near the planar surface. The button has a diameter on the order of one-third the diameter of the cylindrical body, and in a 1½ inch drill head, the button has a diameter of about ⅜ inch. Each of the nozzles has a diameter on the order of 0.012–0.020 inch. It is believed that because of the Coanda effect, the jets produced by the laterally extending nozzles tend to follow the contour of the planar surface and are directed outwardly in a plane perpendicular to the axis of the head.

With the drill head of FIG. 11, the forwardly directed jets first cut into the formation in front of the drill, then the laterally directed jets cut laterally, forming a borehole having a diameter on the order of twice the diameter of the drill head, with an impression of the button at the end of the hole. With only 13 nozzles, it requires only about one-third the flow required for the embodiment of FIG. 10 to cut at approximately the same rate in the same formation.

If desired, an abrasive can be added to the drilling fluid to enhance the drilling rate. Suitable abrasives include silica ($SiO_2$); iron oxides such as hemitite ($Fe_2O_3$), magnetite ($Fe_3O_4$) and limonite ($FeO.OH.NHO_2$); alumina ($Al_2O_3$); garnet ($A_3B_2(SiO_4)_3$, iron slag, copper slag and steel balls, either stainless or carbon steel. The particles of abrasive should preferably be of a size no greater than about ⅙ to ⅕ of the diameter of the openings in the nozzles to prevent bridging of the particles across the openings. By using abrasives, drilling fluid pressure can be reduced from frac pump pressure (10,000–20,000 psi) to mud pump pressure (2500–10,000 psi).

Figure 12:
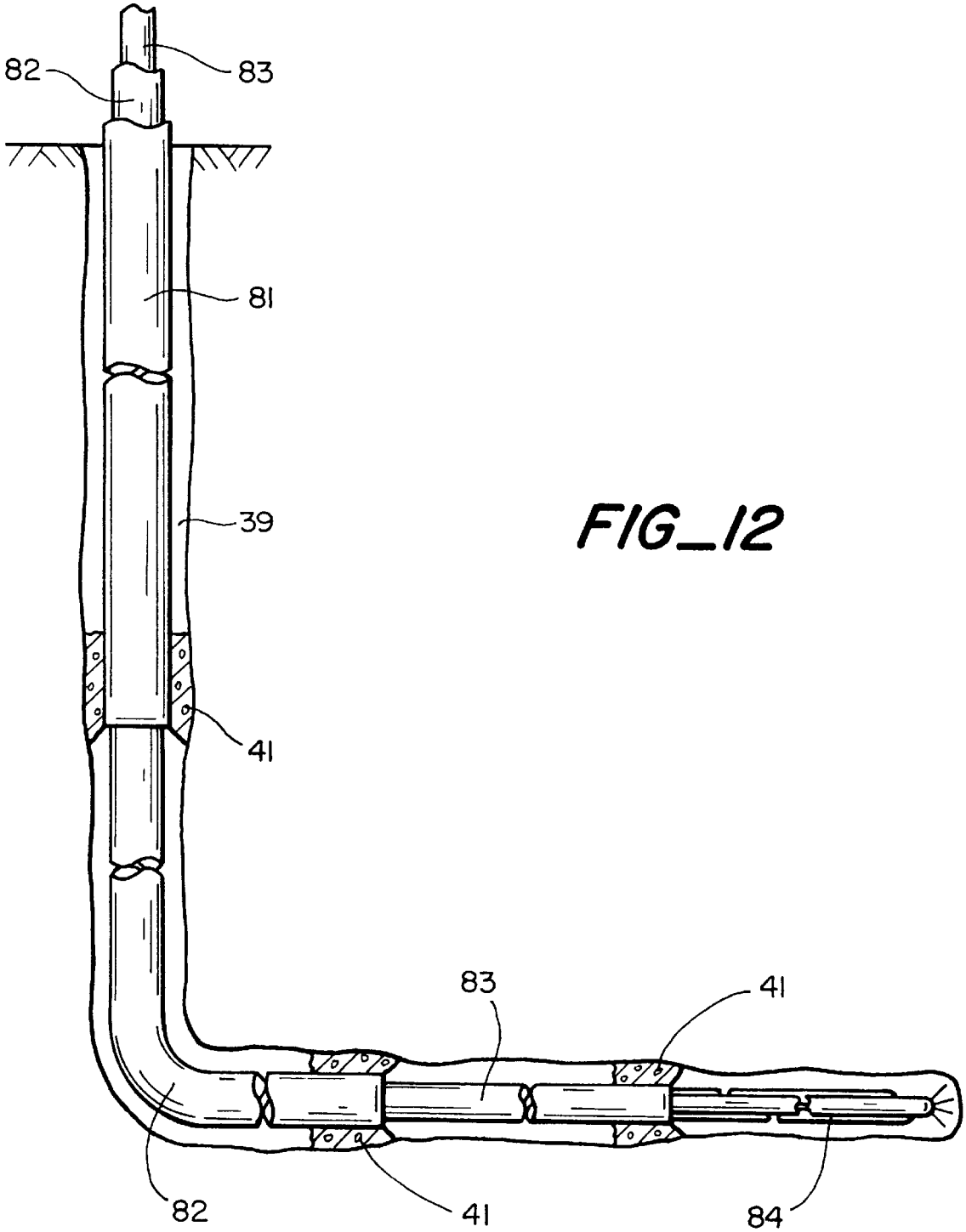
FIG. 12 is a fragmentary elevational view, partly broken away, of another embodiment of apparatus according to the invention.

FIG. 12 illustrates a well drilled in accordance with the invention in which a vertical bore is drilled to a depth of about 8000 feet, using a 9 inch drill string 81. The drill head is then removed from that string, and a 7 inch string 82 is introduced through it and steered around a 90° bend to change the direction of the well from vertical to horizontal. The 7 inch drill head is then removed, and a 4 inch string 83 is introduced to extend the well horizontally up to about 25,000 feet. The 4 inch drill head is then removed, and a module containing a plurality of lateral drilling tubes 84 is pumped down to the distal end of the 4 inch string. The tubes are then extended one at a time to form a pattern of laterals which is determined by the angles of the drill heads at the ends of the tubes.

The invention has a number of important features and advantages. It significantly reduces the time and cost to drill oil and gas wells, particularly offshore wells. Using the drill string as a casing eliminates the need to install a separate casing, and that in itself can result in a saving of up to about 30 percent of on-station time, i.e. the time a drill ship must remain at a site where a well is being drilled. Drilling is done without a mud motor, and drilling control can be implemented while the drilling is being done. Thus, drilling around corners can be done seamlessly and continuously without interruption of the drilling process.

The drill heads can be withdrawn and reinserted without tripping the drill string or drilling tubes, and the system can be operated in a closed loop mode with environmentally non-damaging fluids. The rate of penetration in oil reservoir rocks is comparable to or faster than with conventional rotary drilling. The system operates quietly and does not vibrate or damage electronic or mechanical devices within the drilling and control module at the distal end of the string.

In oil wells with differential permeability, extending multiple laterals in different directions at a given level assures penetration of those areas around the well bore with the highest productivity, i.e. the zones of highest permeability. The angled drill heads produce sufficiently predictable and reproducible paths for the laterals that the need for a guidance and control system for each lateral is eliminated.

By drilling a well with a series of strings of successively smaller diameter, it is possible to extend the well farther than might otherwise be possible.

It is apparent from the foregoing that a new and improved drilling apparatus and method have been provided. While only certain presently preferred embodiments have been described in detail, as will be apparent to those familiar with the art, certain changes and modifications can be made without departing from the scope of the invention as defined by the following claims.

What is claimed is:

1. In hydraulic drilling apparatus for use with an elongated tubular string to which pressurized fluid is applied: a drill head having a cylindrical side wall and a hemispherical nose, a chamber within the body which communicates with the string, and a plurality of vortex generators distributed over the hemispherical nose in the form of nozzles which communicate with the chamber and discharge the pressurized fluid in the form of high velocity vortical cutting jets.

2. The hydraulic drilling apparatus of claim 1 including a plurality of forwardly facing nozzles which are inclined obliquely to the axis of the drill head.

3. The hydraulic drilling apparatus of claim 1 wherein the vortex generators include a plurality of nozzles which are arranged in rings and directed along conical surfaces which have vertices at the center of the hemispherical nose.

4. The hydraulic drilling apparatus of claim 3 wherein the nozzles in adjacent rings are inclined in opposite directions to produce conical masses of drilling fluid which whirl in opposite directions and provide a vortex action upon impact with a formation.

5. The hydraulic drilling apparatus of claim 4 wherein the nozzles are inclined at angles on the order of 5 degrees relative to a line perpendicular to the surface of the nose.

6. In hydraulic drilling apparatus for use with an elongated tubular string to which pressurized fluid is applied: a drill head having a cylindrical body with a forwardly facing planar surface, a hemispherical button projecting from the planar surface, a chamber within the body in communication with the string, a plurality of forwardly facing nozzle openings extending through the hemispherical button and inclined obliquely to the axis of the body for delivering forwardly directed cutting jets of the pressurized fluid, and a plurality of side openings extending laterally through the button in proximity to the planar surface for delivering laterally directed cutting jets of the pressurized fluid.

7. The hydraulic drilling apparatus of claim 6 wherein the button has a diameter on the order of one-third the diameter of the cylindrical body.

* * * * *